United States Patent [19]

Onishi et al.

[11] Patent Number: 4,853,255

[45] Date of Patent: Aug. 1, 1989

[54] PROCESS FOR CONTROLLING CURL IN COATED PAPERS

[75] Inventors: Takami Onishi; Satoshi Dotani, both of Amagasaki, Japan

[73] Assignee: Kanzaki Paper Mfg. Co., Ltd., Tokyo, Japan

[21] Appl. No.: 166,994

[22] Filed: Mar. 11, 1988

Related U.S. Application Data

[63] Continuation-in-part of Ser. No. 935,005, Nov. 26, 1986, abandoned.

[30] Foreign Application Priority Data

Nov. 30, 1985 [JP] Japan ..... 60-270407

[51] Int. Cl.[4] ..... B41M 3/12; B05D 1/00

[52] U.S. Cl. ..... 427/148; 118/217; 118/221; 118/224; 118/225; 118/227; 118/255; 427/152; 427/211; 427/428

[58] Field of Search ..... 427/148, 152, 211, 428; 118/217, 221, 224, 225, 227, 255

[56] References Cited

U.S. PATENT DOCUMENTS 3,320,086 5/1967 Rose et al. ..... 427/211

*Primary Examiner*—Bernard Pianalto

[57] ABSTRACT

A process for controlling curl in coated papers in which the paper web is coated on one side and is wetted with water on the opposite side by a roll-type water applying apparatus, the water applying operation being carried out under such conditions that the relative difference of the surface speed of the applicator roll from the running speed of the paper web is at least 1000 m/min. and preferably the water applicator roll is reversely turning. Curling of the paper is thereby eliminated.

16 Claims, 1 Drawing Sheet

PROCESS FOR CONTROLLING CURL IN COATED PAPERS

CROSS REFERENCE TO RELATED APPLICATION

Figure 1:
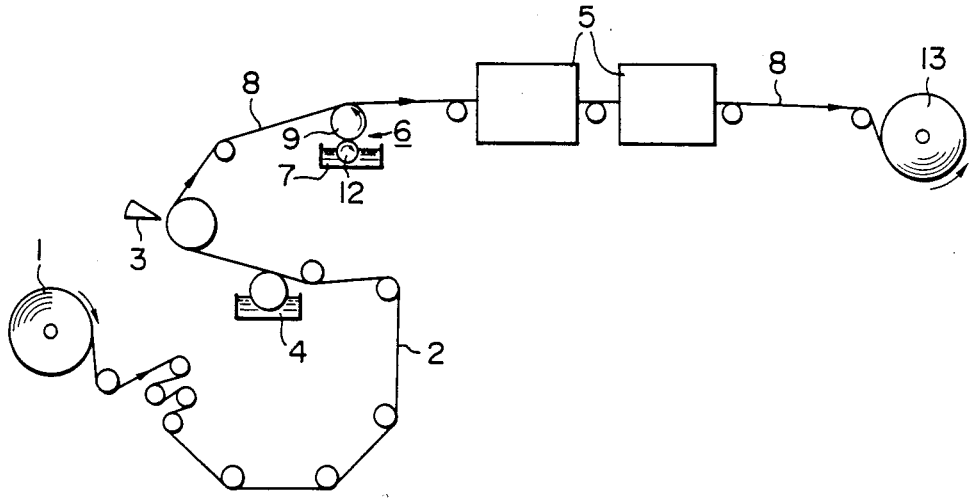

This application is a continuation-in-part of our copending application Ser. No. 935,005, filed Nov. 26, 1986 now abandoned.

BACKGROUND OF THE INVENTION (1) Field of the Invention

The present invention relates to a process for converting a paper web, in which occurrence of curl is effectively prevented in a paper such as coated paper. More particularly, the present invention relates to a paper-converting process in which curling is prevented without formation of translucent specks or undulations or occurrence of the cockle phenomenon.

(2) Description of the Prior Art

In a paper mill, various coated papers such as printing papers, heat-sensitive recording papers and pressure-sensitive recording papers are prepared by applying a coating composition to a paper web in a coater. However, if a coated paper is curled, breaking of the web is readily caused, and therefore the manufacturing speed cannot be increased and the operating efficiency is reduced. Moreover, a product in which curling is caused is poor in the appearance characteristics and is difficult to feed or is likely to jam in the printing step or in a recording step.

The mechanism of occurrence of curling will now be described in brief. In general, one surface of paper is coated with a coating composition by a coater and the paper is then dried. Fibers and fiber clearances on the coated side of the paper contract more than those on the opposite surface when the coating composition is applied and subsequently dried. Therefore, the paper is curled with the coated surface being on the inner side.

Accordingly, a water applying apparatus for preventing occurrence of curl is disposed on a coater to apply an appropriate amount of water or an aqueous solution to the uncoated surface to prevent curling. However, complete prevention of occurrence of curling is impossible. Moreover, when the water applying apparatus is used, translucent specks appear as a new defect; water applied to the back surface of the coated paper arrives at the coated surface through pinholes and when the smoothing treatment is carried out by using a supercalender translucent specks are formed because the water is unevenly distributed in the paper and the areas of high moisture content in the paper web are crushed compared with the areas of low moisture content. In case of thin coated paper, there arises a cockle phenomenon; because of non-uniformity in the amount of water applied or in the water absorption, the water content in the paper becomes non-uniform and in the drying partial shrinkage or wavy deformation occurs. These defects, formation of translucent specks and occurrence of the cockle, result not only in degradation of the appearance of the paper but also in reduction of the recording quality, especially in case of heat-sensitive recording paper. For example, if translucent specks are formed, the specks are concave portions having a small thickness, and, therefore, these specks do not come in contact with a thermal head, and unrecorded spots of an image occur.

With this background, we carried out research with a view of eliminating incomplete correction of curl, formation of translucent specks and occurrence of the cockle phenomenon, especially research on the mechanisms of the generation of these undesirable phenomena in the case where a water applying apparatus is used. As a result we found the following facts. In a water applying apparatus customarily used in conjunction with a coating machine, for example, a two-roll type kiss coater, an applicator roll is rotated in a direction reverse to the direction of travel of the coated paper, and when water, conveyed in the form of a film on the outer surface of the applicator roll, is brought into a wedge-shaped water reservoir defined by the roll and paper, a hydrostatic pressure acts on the water in the water reservoir to intrude water unevenly into the paper layer from the back surface of the coated paper. It is considered that for this reason, the curl-correcting effect becomes insufficient and the cockle phenomenon or formation of translucent specks is caused.

SUMMARY OF THE INVENTION

It is a primary object of the present invention to solve the foregoing problems and provide a process for converting a paper web in which occurrence of curling in the coated paper is prevented without the accompanying defects such as formation of translucent specks and occurrence of the cockle phenomenon. As the result of our research, it was found that if the relative difference of the surface speed of the applicator roll from the running speed of the paper web exceeds a certain value, the above-mentioned hydrostatic pressure is drastically reduced and application of the water to the paper becomes uniform We furthered our research based on this finding and we have now completed the present invention.

More specifically, in accordance with the present invention, there is provided a process for converting a coated paper web, which comprises controlling curling of the paper by wetting the paper web with water by a water applying apparatus, wherein an applicator roll of the water applying apparatus is rotated so that the relative difference of the surface speed of the applicator roll from the running speed of the paper is at least 1000 m/min.

In the case where the back surface of coated paper is wetted with water by an applicator roll in the above-mentioned manner, in order to wet the back surface uniformly across the web without intrusion of water into the paper layer itself, it is indispensable that the applicator roll should be rotated so that the relative difference of the surface speed of the applicator roll from the running speed of the coated paper web is at least 1000 m/min, preferably at least 1200 m/min. In general, the applicator roll is rotated in a direction reverse to the direction of travel of the coated paper web. Accordingly, the relative difference of the speed between the applicator roll and coated paper is equal to the sum of the running speed of the coated paper web and the surface speed of the applicator roll. The upper limit of the relative speed difference is ordinarily 2500 m/min.

The surface speed of a pick-up roll is adjusted so that water necessary for wetting can be supplied to the applicator roll. In general, the surface speed of the pick-up roll is selected within the range of from about 40 to about 300 m/min. customarily adopted in this field. The surface speed of the applicator roll is appropriately set according to the kind of coated paper or the rate of feed of paper to be treated, but the surface speed of the applicator roll is ordinarily adjusted within the range of 100 to 1400 m/min.

In the case where the curling or the cockle phenomenon is extremely conspicuous, if a nip pressure is applied between the applicator roll and the pick-up roll during the operation, the moisture profile in the cross direction is highly improved. Therefore, this method is one of preferred embodiments of the present invention. In a three-roll type kiss coater the nip pressure can be applied between the applicator roll and the squeeze roll. The nip pressure depends on the diameter and composition of the applicator roll and of the pick-up roll or squeeze roll and an appropriate nip pressure is selected with a range of from 0 to 20 kg/cm, preferably from 0.1 to 18 kg/cm, according to the desired moisture profile in the cross direction. The applicator roll is ordinarily formed of a metal such as stainless steel or chromium-plated steel, and a steel roll covered with rubber is ordinarily used as the pick-up roll. The water applying apparatus used in the present invention is not limited to the above-mentioned two-roll kiss coater, but a one-roll type kiss coater and a three-roll type kiss coater can be similarly used.

The reason why the excellent functional effect of the present invention is attained, where the relative difference of the surface speed of the applicator roll from the running speed of the paper web is at least 1000 m/min, has not been completely elucidated. However, from the results of our research it is construed that if the relative difference of the speed is at least 1000 m/min, water conveyed in the form of a thin film on the applicator roll slips on the coated paper by a hydroplaning phenomenon and is applied on the back surface of the coated paper uniformly without substantial generation of the above-mentioned hydrostatic pressure.

The base paper and coating composition used in the present invention are not particularly limited. For example, ordinary coated paper such as clay-coated paper for printing various specialty papers such as heat-sensitive recording paper, pressure-sensitive recording paper, ink jet recording paper and heat transfer paper may be treated according to the process of the present invention.

As pointed out hereinbefore, formation of translucent specks is caused by permeation of the water applied to the back surface through pinholes in the paper. This undesirable phenomenon is especially conspicuous when the air resistance of paper specified by TAPPI STANDARD T-460 is less than 35 seconds/100 ml/in.$^2$, particularly if it is less than 20 seconds/100 ml/in.$^2$ and also when the smoothing treatment is carried out subsequent to the steps of coating with a coating composition, wetting with water and drying (that is, when the smoothing means such as a super-calender follows immediately after). Furthermore, the cockle phenomenon is readily caused when the basis weight of the base paper is low, especially when it is less than 55 g/m$^2$. Accordingly, in the production of heat-sensitive recording paper or pressure sensitive recording paper where the above-mentioned base paper is used or the above-mentioned step is adopted, according to the present invention, curling can be prevented without formation of translucent specks or occurrence of the cockle phenomenon. Consequently, the present invention is very advantageous from the industrial viewpoint.

In order to attain an antistatic effect, an aqueous solution of a salt such as potassium chloride or sodium bicarbonate or glycerol may be used for the water applying operation, and when an aqueous solution of polyvinyl alcohol is used for the water applying operation, the effect of preventing curl can be enhanced.

BRIEF AND DETAILED DESCRIPTION OF THE DRAWINGS

The present invention will now be described with reference to preferred embodiments illustrated in the accompanying drawings.

FIG. 1 diagrammatically illustrates a coating machine provided with a water applying apparatus, employed in a process for converting a paper web according to the present invention.

A paper web 2 is unwound from reel 1 on an unwinder and one surface of the paper 2 is coated with a coating composition applied at station 4. Water is applied to the back surface of the coated paper 8 by a wetting applying apparatus 6 comprising an applicator roll 9 and a pick-up roll 12, and the paper 8 is dried by a dryer 5 and wound on a winder 13.

Figure 2:
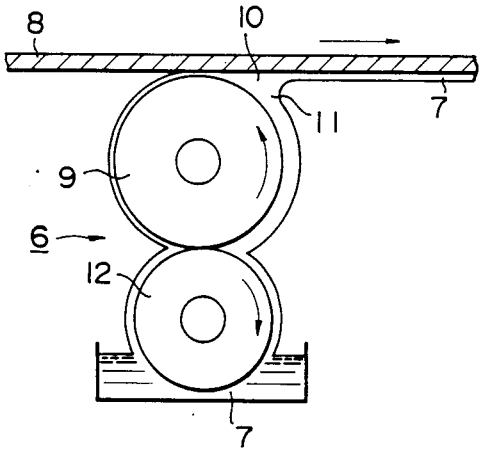

FIG. 2 illustrates an example of the water applying apparatus used in the present invention, in this case a two-roll type kiss coater comprising an applicator roll 9 and a pick-up roll 12, customarily used on a coating machine. The applicator roll 9 is rotated in a direction reverse to the direction of travel of the coated paper 8. When water carried in the form of a thin film on the outer surface of the applicator roll 9 is brought into a water reservoir 11 of a wedgeshaped portion 10 defined by the roll and paper, hydrostatic pressure acts on water in the water reservoir 11, so that water in the water reservoir 11 is unevenly intruded into the paper layer from the back surface of the coated paper 8. According to the present invention, however, by making the relative difference of the surface speed of the applicator roll 9 from the running speed of the coated paper larger than a certain value, water carried in the form of a thin film on the surface of the applicator roll 9 slips on the coated paper 8 because of a hydroplaning phenomenon while the hydrostatic pressure decreases, with the result that water is uniformly applied on the back surface of the coated paper.

Incidentally, in the embodiment shown in FIG. 1, after coating with the coating composition, the back surface is wetted with water and dried. In the present invention, there can also be adopted a method in which wetting with water is first carried out on the back surface and the front surface is then coated with the coating composition and dried, and a method in which the front surface is coated with the coating composition and dried and then the back surface is wetted with water and dried.

The present invention will not be described in detail with reference to the following examples that by no means limit the scope of the invention.

EXAMPLE 1

By using a coater as shown in FIG. 1, a base paper having basis weight of 48 g/m$^2$ (the air resistance was 14 seconds/100 ml/in.$^2$) was coated with a coating composition described below at a coater speed of 500 m/min. so that the amount of coating applied was 3.5 g/m$^2$ (after drying). Then, the back surface was wetted with water under conditions described below, and the paper was dried by a dryer and subjected to the smoothing treatment by a super-calender to obtain a heat-sensitive recording paper. Incidentally, a chromium-plated steel roll having a diameter of 400 mm was used as the applicator roll of the water applying apparatus, and a rubber-covered steel pipe roll having a diameter of 260 mm was used as the pick-up roll.

Coating Composition

An aqueous coating composition for the production of heat-sensitive recording paper, comprising as main components a fluorane type dye, methyl cellulose and benzyl p-hydroxy-benzoate and having a solids concentration of 24% and a viscosity of 300 cps, was used as the coating composition.

Water Applying Conditions

The surface speed of the applicator roll was 800 m/min and the surface speed of the pick-up roll was 110 m/min. A nip pressure was applied between both the rolls so that the amount applied of water was 4.0 cc/m$^2$.

EXAMPLE 2

In the same manner as described in Example 1, a base paper having basis weight of 40 g/m$^2$ (the air resistance was 30 seconds/100 ml/in.$^2$) was coated with the same coating composition for heat-sensitive recording paper as used in Example 1 at a coater speed of 500 m/min. so that the amount of coating applied was 3 g/m$^2$ (after drying). The back surface was wetted with water under conditions described below, and the paper was dried by a dryer and subjected to the smoothing treatment by a super-calender to obtain a heat-sensitive recording paper. The amount of water applied was controlled to 3.0 cc/m$^2$ by the nip pressure.

Water Applying Conditions

The surface speed of the applicator roll was 750 m/min. and the surface speed of the pick-up roll was 120 m/min.

COMPARATIVE EXAMPLE 1

A heat-sensitive recording paper was prepared in the same manner as described in Example 1 except that at the water applying step, the surface speed of the applicator roll was changed to 300 m/min and the surface speed of the pick-up roll was changed to 70 m/min.

COMPARATIVE EXAMPLE 2

A heat-sensitive recording paper was prepared in the same manner as described in Example 2 except that at the water applying step, the surface speed of the applicator roll was changed to 300 m/min. and the surface speed of the pick-up roll was changed to 70 m/min.

EXAMPLE 3

In the same manner as described in Example 1, a base paper having basis weight of 64 g/m$^2$ (the air resistance was 12 seconds/100 ml/in.$^2$) was coated at a coater speed of 400 m/min with a dilution of the coating composition used in Example 1 (the concentration was 20% and the viscosity was 200 cps) so that the amount of coating applied was 5.5 g/m$^2$ (after drying). The back surface was wetted with water under conditions described below, and the paper was dried by a dryer and subjected to the smoothing treatment by a super-calender to obtain a heat sensitive recording paper.

Water Applying Conditions

The surface speed of the applicator roll was 650 m/min. and the surface speed of the pick-up roll was 80 m/min, and a nip pressure was applied between the rolls so that the amount of water applied was 4.5 cc/m$^2$.

COMPARATIVE EXAMPLE 3

A heat-sensitive recording paper was prepared in the same manner as described in Example 3 except that at the water applying step, the surface speed of the applicator roll was changed to 450 m/min.

EXAMPLE 4

In the same manner as described in Example 1, a base paper having basis weight of 40 g/m$^2$ (the air resistance was 30 seconds/100 ml/in.$^2$) was coated at a coater speed of 500 m/min. with a coating composition described below so that the amount of coating applied was 5.5 g/m$^2$ (after drying). Then the back surface was wetted with water under conditions described below, and the paper was dried by a dryer and subjected to the smoothing treatment by a super-calender to obtain a bottom sheet for sets of pressure-sensitive papers.

Coating Composition

An aqueous composition for pressure-sensitive recording paper comprising as main components a color acceptor, aluminum hydroxide and a styrene-butadiene latex and having a concentration of 30% and a viscosity of 60 cps was used.

Water Applying Conditions

The surface speed of the applicator roll was 900 m/min. and the surface speed of the pick-up roll was 150 m/min, and a nip pressure was applied between the rolls to control the amount of water applied to 5.0 cc/m$^2$.

COMPARATIVE EXAMPLE 4

A bottom sheet for the pressure-sensitive recording set of papers was prepared in the same manner as described in Example 4 except that at the water applying step, the surface speed of the applicator roll was reduced to 400 m/min and the surface speed of the pick-up roll was changed to 160 m/min.

With respect to each of the so-obtained one-surface coated paper, curling, formation of translucent specks, occurence of the cockle phenomenon and also the recording quality of heat-sensitive recording paper were checked and overall evaluation was made. The obtained results are shown in Table 1.

The curling test was carried out according to "Curling Test Method II for Paper" (Paper and Pulp Test Method No. 1677 of JAPAN TAPPI). Namely, a test piece having a size of 50 mm×50 mm was hung in open air for 24 hours, and the curling degree of the test piece was measured by a curling degree measuring glass gauge (a smaller value indicates a lower degree of curling).

Formation of translucent specks was checked with the naked eye while holding the sample to the light source. Occurrence of the cockle phenomenon was checked by examining the appearance with the naked eye. The recording quality was evaluated based on whether or not unrecorded spots were caused in a record image when the heat-sensitive recording paper was subjected to the recording test using a thermal printer (UP-103 supplied by Sony).

In Table 1 the values obtained are indicated by the following explanatory notes:

The standard for evaluation of the recording quality was as follows:

O: record image free of unrecorded spots was obtained

X: portions of translucent specks were not recorded and unrecorded spots were caused in the record image The standard for evaluation of formation of translucent specks, occurrence of the cockle phenomenon and overall evaluation was as follows:

1: excellent
2: fair
3: slightly inferior
4: inferior
5: extremely inferior

As is apparent from the results shown in Table 1, in each of the one-surface-coated papers prepared according to the process of the present invention (Examples 1 through 4, curl was effectively prevented, and formation of translucent specks or occurrence of the cockle phenomenon was virtually eliminated and a good record image was obtained in the heat-sensitive recording paper. In contrast, in the case where the relative difference of the surface speed of the applicator roll from the running speed of paper was less than 1000 m/min (Comparative Examples 1 through 4), with respect to curling, formation of translucent specks and occurrence of the cockle phenomenon, the obtained papers were inferior to the papers obtained according to the process of the present invention. Also, the heat-sensitive recording papers produced where the relative difference in speed was less than 1000 m/min were inferior in that the record images formed on the papers had unrecorded spots.

TABLE 1

| Item | Unit | Example 1 | Comp. Exam. 1 | Example 2 | Comp. Exam. 2 | Example 3 | Comp. Exam. 3 | Example 4 | Comp. Exam. 4 |
|---|---|---|---|---|---|---|---|---|---|
| Coater Conditions | | | | | | | | | |
| Basis Weight of Paper | $g/m^2$ | 48 | 48 | 40 | 40 | 64 | 64 | 40 | 40 |
| Air Resistance of Base Paper | sec/100 ml/in.$^2$ | 14 | 14 | 30 | 30 | 12 | 12 | 30 | 30 |
| Coating Weight | $g/m^2$ | 3.5 | 3.5 | 3.0 | 3.0 | 5.5 | 5.5 | 5.5 | 5.5 |
| Web Speed | m/min | 500 | 500 | 500 | 500 | 400 | 400 | 500 | 500 |
| Water-Applying Conditions | | | | | | | | | |
| Surface Speed of Applicator Roll | m/min | 800 | 300 | 750 | 300 | 650 | 450 | 900 | 400 |
| Relative Speed Difference | m/min | 1300 | 800 | 1250 | 800 | 1050 | 850 | 1400 | 900 |
| Surface Speed of Pick-up Roll | m/min | 110 | 70 | 120 | 70 | 80 | 80 | 150 | 160 |
| Nip Pressure | Kg/cm | applied | applied | applied | applied | applied | applied | applied | applied |
| Amount of Water Applied | $cc/m^2$ | 4.0 | 4.0 | 3.0 | 3.0 | 4.5 | 4.2 | 5.0 | 4.7 |
| Evaluation of Quality | | | | | | | | | |
| Curling | | 5 | 35 | 5 | 30 | 3 | 7 | 9 | 40 |
| Translucent Specks | | 1 | 5 | 1 | 3 | 1 | 5 | 1 | 2 |
| Cockle Phenomenon | | 2 | 4 | 1 | 3 | 1 | 2 | 2 | 5 |
| Recording Quality | | O | X | O | X | O | X | — | — |
| Overall Evaluation | | 1 | 4 | 1 | 3 | 1 | 4 | 1 | 3 |

What is claimed is:

1. A process for controlling curl in coated paper without the formation of translucent specks or cockle which comprises applying a coating composition to one surface of a web of base paper and wetting the other surface of said web of paper with water by means of an applicator roll of a kiss roll coater from the group consisting of a one-roll kiss coater, a two-roll kiss coater and a three-roll kiss coater wherein the relative difference of the surface speed of said applicator roll from the running speed of said paper web is at least 1000 m/min.

2. The process as claimed in claim 1 wherein the relative difference of the surface speed of said applicator roll from the running speed of said paper web is at least 1200 m/min.

3. The process as claimed in claim 1 wherein a nip pressure is applied between the applicator roll and the pick-up roll.

4. The process as claimed in claim 1 wherein the air resistance of the base paper is less than 35 seconds/100 ml/in.$^2$ as determined according to TAPPI STANDARD T460.

5. The process as claimed in claim 1 where the coated paper is one from the group consisting of coated printing papers, pressure-sensitive recording papers, heat-sensitive recording papers, heat transfer recording papers and ink jet recording papers.

6. The process for controlling curl in coated paper without the formation of translucent specks or cockle which comprises applying a coating composition to one side of a web of base paper and wetting the other surface of said web of paper with water by means of a reversely-turning applicator roll of a kiss roll coater from the group consisting of a one-roll kiss coater, a two-roll kiss coater and a three-roll kiss coater, wherein the relative difference of the surface speed of said reversely-turning applicator roll from the running speed of said paper web is at least 1000 m/min.

7. The process as claimed in claim 6 wherein the relative difference of the surface speed of said applicator roll from the running speed of said paper web is at least 1200 m/min.

8. The process as claimed in claim 6 wherein a nip pressure is applied between the applicator roll and the pick-up roll.

9. The process as claimed in claim 6 wherein the air resistance of the base paper is less than 35 seconds/100 ml/in.$^2$ as determined according to TAPPI STANDARD T460.

10. The process as claimed in claim 6 wherein the coated paper is one from the group consisting of coated printing papers, pressure-sensitive recording papers, heat-sensitive recording papers, heat transfer recording papers and ink jet recording papers.

11. A process for controlling curl in coated paper without the formation of translucent specks or cockle which comprises applying a coating composition to one side of a web of base paper and wetting the other surface of said web with water by means of a reversely-turning applicator roll of a kiss roll coater wherein a nip pressure is applied at said applicator roll, said nip pressure in a two-roll kiss coater being applied between the applicator roll and the pick-up roll and said nip pressure in a three-roll kiss coater being applied between the applicator roll and a squeeze roll, and wherein the relative difference of the surface speed of said reversely-turning applicator roll from the running speed of said paper web is at least 1000 m/min.

12. The process as claimed in claim 11 wherein the relative difference of the surface speed of said applicator roll from the running speed of said paper web is at least 1200 m/min.

13. The process as claimed in claim 11 wherein the surface speed of said applicator roll is 100 to 1400 m/min.

14. The process as claimed in claim 11 wherein the air resistance of the base paper is less than 35 seconds/100 ml/in.$^2$ as determined according to TAPPI STANDARD T460.

15. The process as claimed in claim 11, wherein the coated paper is one from the group consisting of coated printing papers, pressure-sensitive recording papers, heat-sensitive recording papers, heat transfer recording papers and ink jet recording papers.

16. The process as claimed in claim 11 wherein said nip pressure is in the range of 0.1 to 18 kg/cm.

* * * * *